United States Patent [19]

Odhner

[11] 4,104,759

[45] Aug. 8, 1978

[54] CUSTODIAL ERASER

[76] Inventor: Oliver R. Odhner, R.D. #2, Gerloff Rd., Schwenksville, Pa. 19473

[21] Appl. No.: 792,921

[22] Filed: May 2, 1977

[51] Int. Cl.[2] ..... A46B 3/02; B43L 21/00

[52] U.S. Cl. ..... 15/176; 15/224

[58] Field of Search ..... 15/114, 176, 201, 202, 15/209 R, 221, 223, 224

[56] References Cited

U.S. PATENT DOCUMENTS

| | | | |
|---|---|---|---|
| 2,679,063 | 5/1954 | Hoffman | 15/114 X |
| 2,842,791 | 7/1958 | Statler | 15/209 R |
| 3,641,610 | 2/1972 | Lewis | 15/223 X |
| 3,798,699 | 3/1974 | Lewis | 15/201 |
| 4,007,509 | 2/1977 | Odhner | 15/221 X |

*Primary Examiner*—Daniel Blum

*Attorney, Agent, or Firm*—Frederick J. Olsson

[57] ABSTRACT

A light weight, substantially rigid, C-shaped handle which independently holds three serially arranged individual erasers. A flexible foam strip is interposed between the handle and the individual erasers. Means are provided to maintain the erasers within the handle against the strip which allows the erasers to independently move in response to hand pressure.

5 Claims, 6 Drawing Figures

CUSTODIAL ERASER

This invention relates to black or chalk board erasers and in particular relates to a custodial or maintainance type of eraser, i.e. one having an extended length which provides for clearing off a large swath as the eraser is swept across the board to thereby reduce the cleaning time.

One object of the invention is to provide a custodial eraser which has an elongated, rigid handle mounting a plurality of individual erasers against a strip of flexible foam, the foam permitting the individual erasers to independently yield in response to hand pressure as the eraser is moved across the board.

Another object of the invention is to provide a custodial eraser of the kind in question wherein the individual erasers can be either the conventional felt type or the fiberglass type shown in my U.S. Pat. No. 4,007,509.

Another object of the invention is to provide a custodial eraser of the kind in question which has an elongated, rigid, C-shaped light-weight handle having means to independently support a plurality of individual erasers within the handle against a strip of flexible foam.

Another object of the invention is to provide a custodial eraser of the kind in question wherein the handle is made of thin aluminum bent into a flanged C-shape which achieves lightness with rigidity.

Another object of the invention is to provide a custodial eraser of the kind in question having structure which achieves substantially uniform wear along the axis of the eraser.

Another object of the invention is to provide a custodial eraser of the kind in question wherein the individual erasers can be quickly changed in position and/or replaced.

Another object of the invention is to provide a custodial eraser of the kind in question wherein dust is contained at both of the opposite ends and also at intermediate points of the eraser.

Another object of the invention is to provide a custodial eraser of the kind in question wherein the individual erasers are retained in the handle by adhesive means on the flexible foam and inwardly extending flanges on the handle.

Another object of the invention is to provide a custodial eraser of the kind in question wherein the individual erasers are retained in the handle by plates on the opposite ends of the handle and inwardly extending flanges.

Another object of the invention is to provide a custodial eraser of the kind in question wherein the individual erasers are retained in the handle by adhesive means joining the foam and the handle and the foam and each eraser.

One of the primary advantages of the invention is economy in manufacturing, for example;

(a) Both the conventional size eraser and the custodial size can be offered with the inventory of the more costly parts being held to a minimum. This comes about particularly because the identical erasing element is employed in both types.

(b) The flexible foam and pressure sensitive adhesive tape can be purchased in rolls of standard width which are lower in cost than custom items.

(c) The use of a strip of flexible foam as a yielding element to support individual erasers provides a simple, and low cost arrangement which reliably performs its intended function.

(d) The components can be quickly and easily arranged in the combination so that fabrication time is minimal.

Another primary advantage of the invention is in efficiency and economy from the standpoint of the user, for example:

(a) The fact that the individual erasers can independently yield reduces the very common fault of custodial erasers to wear down in a non-uniform manner.

(b) If non-uniform wear does occur, the erasers can be quickly reversed in position and/or replaced.

(c) In employing the type of eraser shown in U.S. Pat. No. 4,007,509 the dust is blocked not only in each end but at intermediate points so that superior dust containment is achieved.

The invention will be described below in connection with the following drawings wherein.

Figure 1:
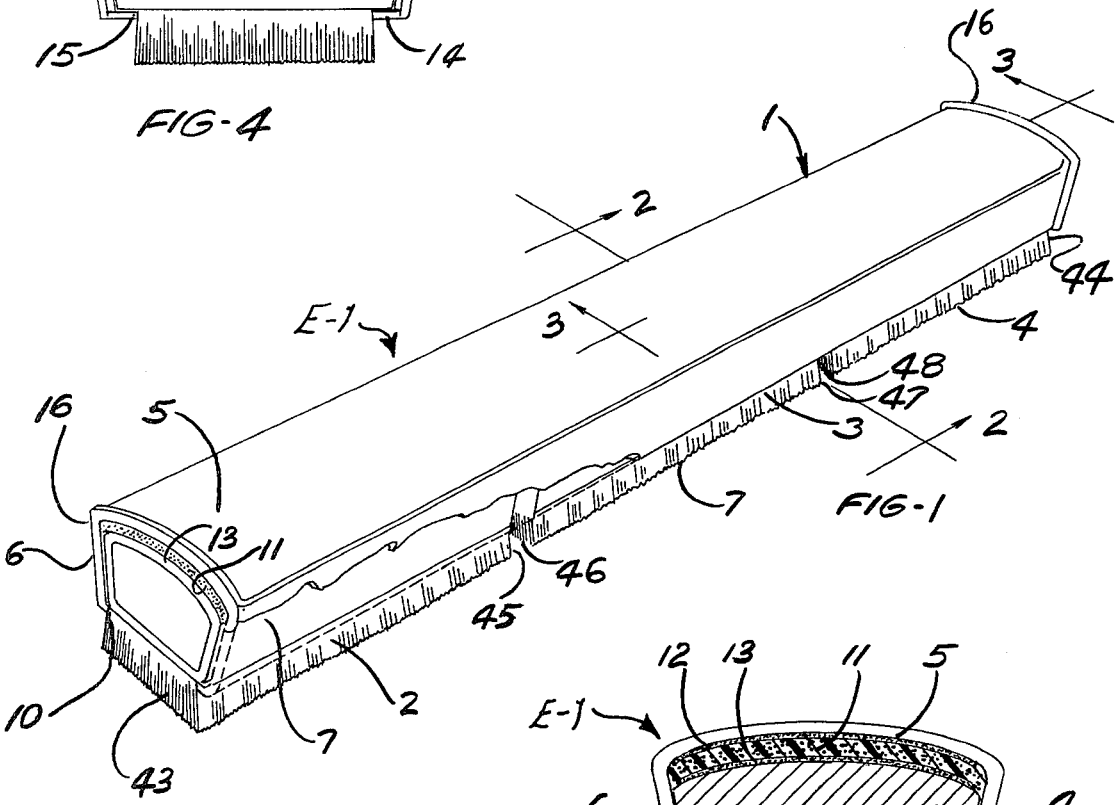
FIG. 1 is a perspective view of a custodial eraser constructed in accordance with the invention.
Figure 2:
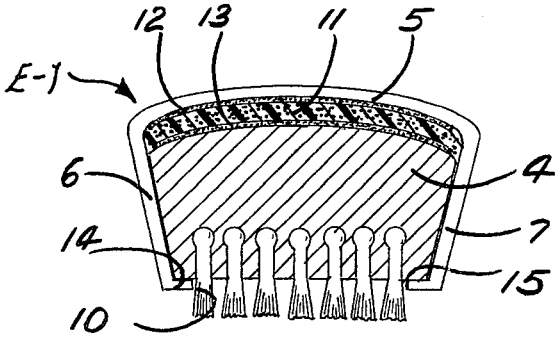
FIG. 2 is an elevational view taken along the lines 2—2 of FIG. 1 and illustrating one method of retaining the individual erasers in position.

In FIGS. 1 and 2 the eraser E-1 has a hollow, elongated handle indicated at 1. Within the handle 1 are a plurality of individual erasers 2, 3 and 4 which are serially arranged along the axis of the handle. These erasers are of the fiberglass type as shown in my U.S. Pat. No. 4,007,509 issued Feb. 1977. The disclosure describing such erasers is incorporated herein by reference.

With reference to FIG. 2, the handle 1 has closed side 5 and a pair of walls 6 and 7 which extend outwardly from the closed side. The space between the extremities of the walls constitutes an open side 10. The individual erasers extend thru and outwardly of the open side 10.

A strip 11 of flexible foam, preferably polyurethane foam, extends along and co-extensive with the closed side 5. The upper part of each eraser engages or is coupled with the foam. An adhesive 12, preferably a double sided pressure sensitive tape, is employed between the underside of the closed side 5 and the top of the foam 11 and holds the foam in position against sliding along the axis of the handle. A similar tape 13 is employed between the top of each eraser and the foam and the adhesive 13 constrains the eraser against movement relative to the foam in a direction along the axis of the handle. The walls 6 and 7 hold both the tape and erasers against transverse movement.

The outer extremity of the wall 6 has an inwardly extending flange 14 and the wall 7 has a similar flange 15. The flanges are co-extensive with the handle and project underneath each eraser. The flanges are disposed so as to maintain erasers in the handle firm against the foam and slightly compress the same.

It will be apparent that the adhesive 12 and 13 and the flanges 14 and 15 provide a means to maintain the erasers in the housing and in contact with the foam.

The eraser E-1 is used by gripping in the hand with the palm engaging the closed side 5 and the fingers engaging the walls 6 and 7. The unit is placed in position with the fibers of the individual erasers engaging the board and with the axis of the handle at a slight angle to the vertical. For cleaning, the unit is swept back and forth across the board while in the angled position.

The handle 11 is preferably made of 24 gage anodized aluminum sheet metal bent into the flanged C-shaped by conventional brake tooling. The C-shape and flange structure provides a handle of substantial rigidity but with desirable light weight.

Each of the opposite ends of the handle is provided with a strip of plasticized PVC tape 16 to cover the relatively thin edges and avoid damage.

For assembly purposes, the tape 12 is cut and placed in position on the side 5. Then the foam 11 is cut to length and pressed on the tape 12. The walls 6 and 7 are slightly spread apart and the erasers pushed into position (one-by-one) on the tape 13. The erasers are pushed hard against the foam and then released with the walls 6 and 7 squeezed inwardly to insure the flanges 14 and 15 contain individual erasers. The individual erasers are quickly removed by spreading the walls 6 and 7 and peeling an eraser away from the tape 13 and out of the open side 10.

The foam 11 has a flexibility so that an upward force on an individual eraser generated during a cleaning operation will cause the foam to yield and allow the eraser to move inwardly toward the closed side. Depending upon location of the force an individual eraser may move directly inward as a unit or may tilt with one part moving farther inward than another part. With the individual erasers individually supported on the foam, each eraser is capable of independent movement.

The yielding characteristic as described above is important from the standpoint of achieving substantially uniform wear along the length of the unit. Such uniform wear is highly desirable for uniform and efficient cleaning.

In the event non-uniform wear should occur, the individual erasers can be easily changed in position or replaced in a manner as described above.

Figure 3:
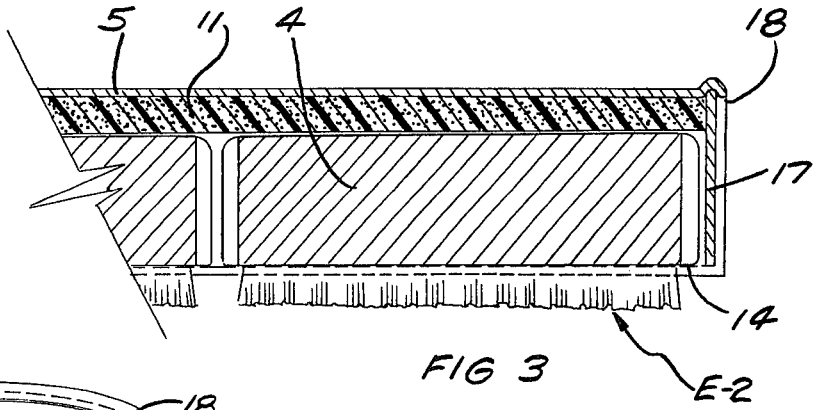
FIG. 3 is a sectional elevational view illustrating another method of securing the individual erasers in position, the view is taken at 3—3 in the eraser of FIG. 1 having the modification.
Figure 4:
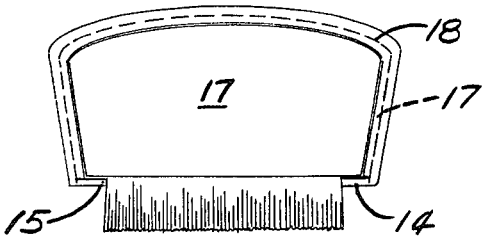
FIG. 4 is an end view looking toward the left in FIG. 3.

In FIGS. 2 and 3 the individual erasers are held in position by the tapes 12 and 13 and by the flanges 14 and 15. In FIGS. 3 and 4 I have illustrated an alternative structure for maintaining the erasers in position.

The eraser E-2 is the same as the eraser E-1 with modifications as noted following. Each end of the handle has an end plate such as the end plate 17. The plate is captured on the bottom by the flanges 14 and 15 and peripherally by the crimped edge 18. The flanges maintain the erasers in firm contact with foam and the plates hold the erasers and foam against movement along the axis of the handle. In this instance, the adhesive between the foam and the closed side and the adhesive between the strip and the eraser tops can both be eliminated.

Figure 5:
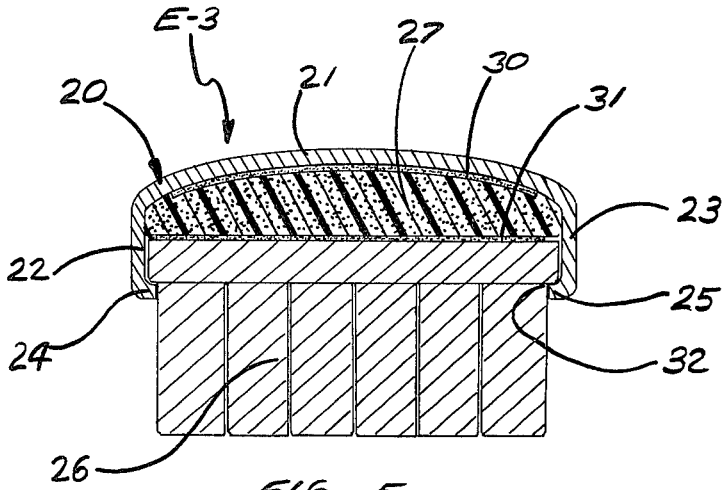
FIG. 5 is a sectional elevational view illustrating another method of retaining the individual erasers in position.

In FIGS. 1 and 2 the erasers 2, 3 and 4 are the type shown in my above mentioned patent, however, erasers may be the conventional felt type. A typical arrangement is illustrated in FIG. 5.

The eraser E-3 has a handle 20 with closed side 21 and walls 22 and 23 and inwardly directed flanges 24 and 25. A plurality of felt erasers, one of which is indicated at 26 are disposed in and along the handle.

A foam strip 27 similar to the strip 11 is joined to the closed side 21 by the tape 30. The eraser 26 is held in contact with the foam 27 by the tape 31. The flanges 24 and 25 maintain the eraser firm against the foam. The erasers extend thru and outwardly of the open side 32.

The handle 20 is made of sheet aluminum and formed into the flanged C-shape similarly as the handle 11 and functions in the same manner. The tapes 30 and 31 and the foam 27 are similarly constructed and function in the same manner as tapes 12 and 13 and foam 11.

Figure 6:
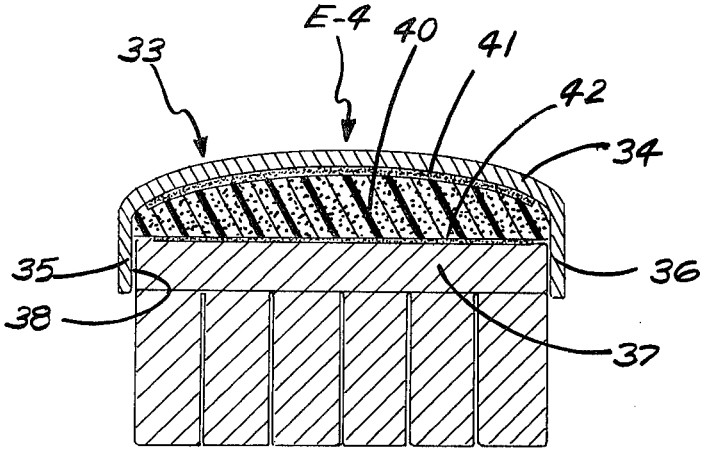
FIG. 6 is a sectional elevational view illustrating another method of retaining the individual erasers in position.

In FIG. 6 I have illustrated another method for maintaining the erasers on the handle. In this particular arrangement, I have illustrated the individual erasers as being the felt type.

The eraser E-4 has a handle 33 with closed side 34 and walls 35 and 36. A plurality of felt erasers, one of which is indicated at 37 are disposed along the handle and extend outwardly thru the open side 38.

The foam strip 40 extends along the handle of contact with the underside of the closed side and in contact with the tops of the erasers. Tapes 41 and 42 are employed respectively between the foam and the side 33 and the foam and the tops of the erasers.

Flanges are omitted on the walls 35 and 36. The adhesive power of the tapes is relied upon to maintain the eraser on the handle. For such purposes, a high adhesion tape such as "Scotch" brand double coated pressure sensitive tape No. 400 manufactured by the 3-M Company is employed.

In the embodiment of FIG. 6, the handle is formed of aluminum and preferably of thicker gage than the handles 1 and 33. The foam 27 functions similarly as the foam 11 and the foam 40.

With respect to the use of fiberglass or felt erasers, the fiberglass type is preferred because superior dust collection and higher efficiency are attained.

With the fiberglass type, blocking rows of fibers appear at each end of the unit, for example, the rows 43 and 44 indicated in FIG. 1. In addition, there are blocking rows intermediate the ends such as the rows 45 and 46 and also the rows 47 and 48.

In closing, it is pointed out that while I have shown the aluminum in the handles and the various tapes to be relatively thick, it is to be understood that this has been done for descriptive purposes.

I claim:

1. A custodial eraser comprising:

an elongated handle to be gripped by the hand and guided over the board for the erasing operation, the handle being C-shaped in cross section to provide a closed side and a pair of spaced apart walls extending outwardly from the closed side, the space between the extremities of the walls forming an open side and during an erasing operation the closed side being adapted to be contacted by the palm of the hand and the walls to be contacted by the fingers;

a section of flexible foam on the inside of the closed said and being co-extensive with the handle;

a plurality of individual erasers disposed within and serially arranged along the housing, each being coupled to said foam and extending thru and outwardly of the open side;

means to maintain the individual erasers within the handle in engagement with the foam and providing for each eraser to be disengageable from the foam and handle;

the flexibility of said foam and said means providing for the individual erasers to compress the foam and independently move toward the closed side in response to hand pressure when the eraser is being moved over the board for an erasing operation and to move away from the closed side when the hand pressure is relieved.

2. The eraser of claim 1 wherein said means comprises adhesive means between the foam and the closed side and between the foam and each eraser.

3. A custodial eraser comprising:

an elongated handle to be gripped by the hand and guided over the board for the erasing operation;

flexible foam means mounted on the handle;

a plurality of individual erasers serially arranged along the handle, each being in contact with said foam and each eraser having a plurality of parallel cleaning rows, each row being comprised of a plurality of fiberglass filaments and the rows forming a plurality of channels and at the respective opposite ends of the channels a blocking row of fiberglass filaments closing off the same, the closed channels functioning to confine the chalk dust and thereby prevent the dust from falling away during the erasing operation;

means to maintain the individual erasers on the handle in contact with the foam; and said foam and said means providing for the individual erasers to independently move in response to hand pressure when the eraser is being moved over the board for an erasing operation.

4. A custodial eraser comprising:

an elongated handle to be gripped by the hand and guided over the board for the erasing operation, the handle being C-shaped in cross section to provide a closed side and a pair of spaced apart walls extending outwardly from the closed side, the space between the extremities of the walls forming an open side and during an erasing operation the closed side being adapted to be contacted by the palm of the hand and the walls to be contacted by the fingers;

a section of flexible foam on the inside of the closed side and being co-extensive with the handle;

a plurality of individual erasers disposed within and serially arranged along the housing, each being coupled to said foam and extending thru and outwardly of the open side;

means to maintain the individual erasers within the handle in contact with the foam;

said foam and said means providing for the individual erasers to independently move toward and away from the closed side in response to hand pressure when the eraser is being moved over the board for an erasing operation; and said means comprising an end plate at each end of the handle and structure securing the plates in position, the plates respectively restraining movement of the eraser in a direction along the axis of the handle and inwardly extending flanges respectively on the extremities of the walls and tightly engaging each eraser and limiting movement of the same in a direction away from the closed side.

5. A custodial eraser comprising:

an elongated handle to be gripped by the hand and guided over the board for the erasing operation, the handle being C-shaped in cross section to provide a closed side and a pair of spaced apart walls extending outwardly from the closed side, the space between the extremities of the walls forming an open side and during an erasing operation the closed side being adapted to be contacted by the palm of the hand and the walls to be contacted by the fingers;

a section of flexible foam on the inside of the closed side and being co-extensive with the handle;

a plurality of individual erasers disposed within and serially arranged along the housing, each being coupled to said foam and extending thru and outwardly of the open side;

adhesive means between the foam and each eraser which restrains movement of the eraser relative to the foam in a direction along the axis of the handle;

inwardly extending flanges respectively on the extremities of the walls and tightly engaging each eraser and limiting movement of the same in a direction away from the closed side; and said foam and said flanges providing for the individual erasers to independently move toward and away from the closed side in response to hand pressure when the eraser is being moved over the board for an erasing operation.

* * * * *